US007399207B2

(12) United States Patent
Fryzek et al.

(10) Patent No.: US 7,399,207 B2
(45) Date of Patent: Jul. 15, 2008

(54) COAXIAL CONNECTOR AND METHOD FOR CONNECTING CABLE TO SAME

(75) Inventors: Aaron P. Fryzek, Wheaton, IL (US); Aaron O'Brien, Munster, IN (US); Michael S. Woo, Northbrook, IL (US)

(73) Assignee: Juno Manufacturing, Inc., Des Plaines, IL (US)

( * ) Notice: Subject to any disclaimer, the term of this patent is extended or adjusted under 35 U.S.C. 154(b) by 0 days.

(21) Appl. No.: 11/278,252

(22) Filed: Mar. 31, 2006

(65) Prior Publication Data

US 2007/0232136 A1 Oct. 4, 2007

(51) Int. Cl.
*H01R 9/05* (2006.01)

(52) U.S. Cl. ..... 439/578

(58) Field of Classification Search ..... 439/578–585, 439/314, 332, 95, 63, 675, 784–785, 796, 439/797, 801, 803, 809, 810
See application file for complete search history.

(56) References Cited

U.S. PATENT DOCUMENTS 3,465,281 A * 9/1969 Florer ..... 439/322
3,675,181 A * 7/1972 Lankford et al. ..... 439/581
4,076,367 A * 2/1978 Avins ..... 439/583
5,670,744 A * 9/1997 Ritchey ..... 174/51
6,808,407 B1 * 10/2004 Cannon ..... 439/314

* cited by examiner

*Primary Examiner*—Edwin A. León
(74) *Attorney, Agent, or Firm*—Sonnenschein Nath & Rosenthal LLP

(57) ABSTRACT

A connector is provided for electrically connecting a coaxial cable having a conductive inner wire surrounded by a conductive outer jacket and an insulator therebetween to a two-wire circuit. The connector comprises a conductive bottom contact member having a first passageway dimensioned to fit only the inner wire and the insulator therethrough and to block the conductive outer jacket. A conductive top contact member has a second passageway for the inner wire and the insulator and a clamping member for securing the inner wire to the top contact member. An insulating member for electrically separates the bottom contact member from the top contact member. A pendant-style light fixture using the coaxial connector is also disclosed.

22 Claims, 7 Drawing Sheets

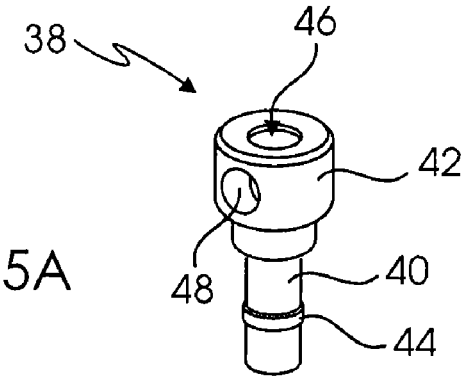
Fig. 5A
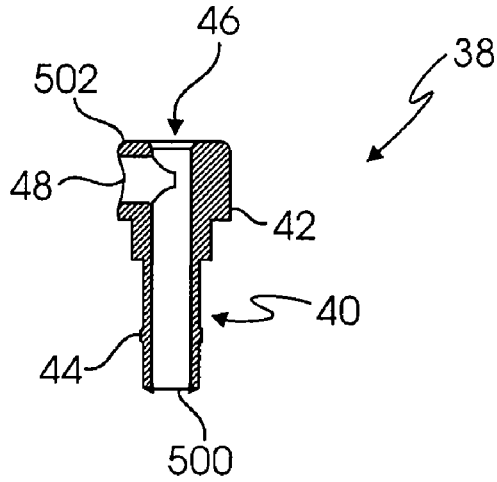
Fig. 5B
Fig. 6
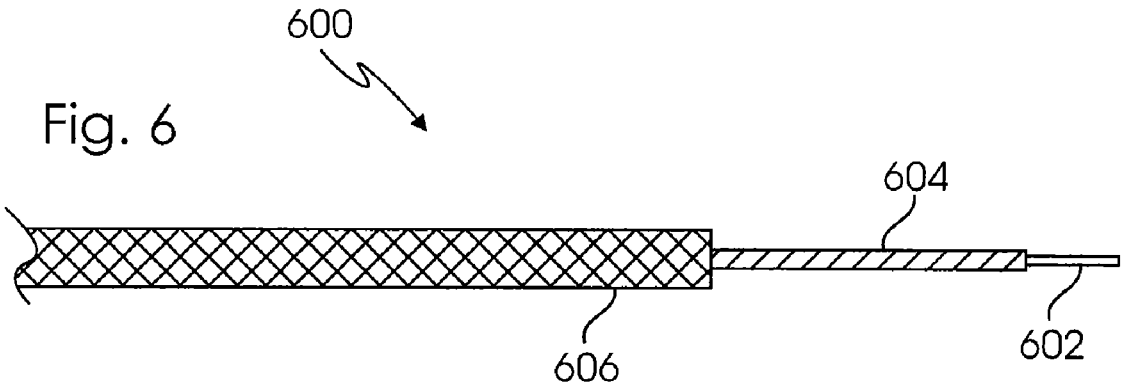

COAXIAL CONNECTOR AND METHOD FOR CONNECTING CABLE TO SAME

FIELD

The present embodiments relate, generally, to coaxial cable connectors and, more particularly, to connectors for pendant-style electrical fixtures.

BACKGROUND

Currently in the lighting industry, many lighting manufacturers produce low voltage pendant-style electrical fixtures. These pendant-style electrical fixtures are produced for lighting highlighting artwork, collections or architectural details, and can also provide general or task illumination for an entire room or a portion of a room.

Each conventional low voltage pendant-style fixture is suspended from a ceiling mounted fixture or supportive structure via a coaxial cable secured to a coaxial connector. In turn, the coaxial connector is fastened to a mating member of the ceiling mounted fixture to provide support and electric current to the pendant-style fixture. The coaxial cable is the current carrying element of the low voltage pendant-style fixture.

Generally, a conventional low voltage pendant-style fixture is configured to provide a cable adjustment feature to enable a modification of the length of the coaxial cable in order to hang the respective fixture at a suitable height or distance from ceiling mounted fixture or supportive structure. Typically, the cable length adjustment is performed by detaching the cable from the coaxial connector, trimming the cable to a predetermined length, and reconnecting the cable to the coaxial connector for mating to the ceiling mounted fixture. However, due to the structural composition of the coaxial cable which typically includes a braided outer jacket or sheath and a insulated inner wire, an installer or user may find the coaxial cable length adjustment to be a tedious and imprecise process.

Furthermore, during a reconnection of the coaxial cable to the coaxial connector, strands of the braided outer member may become frayed and come into contact with other current carrying elements of the connector, thereby potentially resulting in either a short circuit or an open electrical connection. When proper electrical contact is not achieved, the coaxial cable and connector contact points need to be visibly checked or the electrical fitting between coaxial cable and connector needs to be disassembled. Unfortunately, in typical coaxial connectors, contact points are not readily visible.

Moreover, conventional coaxial connectors utilize a screw to achieve a secure mechanical attachment to the coaxial cable which typically damages the outer braided member of the cable, thereby requiring a trimming or shortening of the cable prior to reattaching to the coaxial connector. This trimming of the cable may prevent the user or installer from hanging the light fixture at the desired or suitable height, and may lead to the purchase of another cable. Thus, this cable trimming engenders loss of time and materials.

Therefore, a need exists for a coaxial connector that overcomes the problems noted above and others previously experienced when operating as an electrical contact and mechanical support for a pendant-style fixture. These and other needs will become apparent to those of skill in the art after readying the present specification.

SUMMARY

The foregoing problems are solved and a technical advance is achieved by the present embodiments. A connector is provided for electrically connecting a coaxial cable to a two-wire circuit. The coaxial cable has a conductive inner wire surrounded by a conductive outer jacket and an insulator therebetween for a two-wire circuit. The connector comprises a conductive bottom contact member having a first passageway dimensioned to fit only the inner wire and the insulator therethrough blocking the conductive outer jacket. A conductive top contact member has a second passageway for the inner wire and the insulator and a clamping member for securing the inner wire to the top contact member. An insulating member electrically separates the bottom contact member from the top contact member.

In one aspect, the connector includes a bottom cover member that threadably engages the bottom contact member for securing the outer jacket therebetween.

In another aspect, the connector comprises a conductive outer contact member that rotatably surrounds the bottom contact member and is removably secured to the bottom contact member for securing the connector to a mating connector.

In another aspect, the bottom contact member has a tubular extension having an outer diameter narrower than an inner diameter of the jacket so that the jacket slides over the tubular extension.

Other systems, apparatus, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings:

FIGS. 5*a* and 5*b* illustrate a perspective view and a cross-sectional view of an upper contact member of the coaxial connector of FIG. 1;

FIG. 6 is a side view of an embodiment of a coaxial cable which may be used with the coaxial connector of FIG. 1;

DETAILED DESCRIPTION OF THE DRAWINGS

Reference will now be made in detail to an implementation consistent with the present invention as illustrated in the accompanying drawings. Wherever possible, the same reference numbers will be used throughout the drawings and the following description to refer to the same or like parts.

Figure 1:
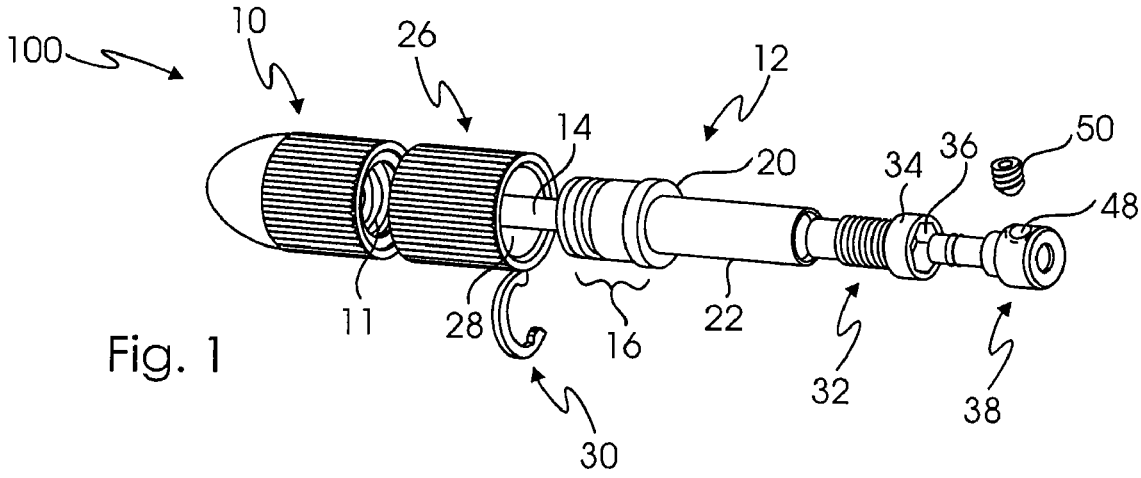
FIG. 1 is an exploded view of an embodiment of a coaxial connector in accordance with the invention.
Figure 2:
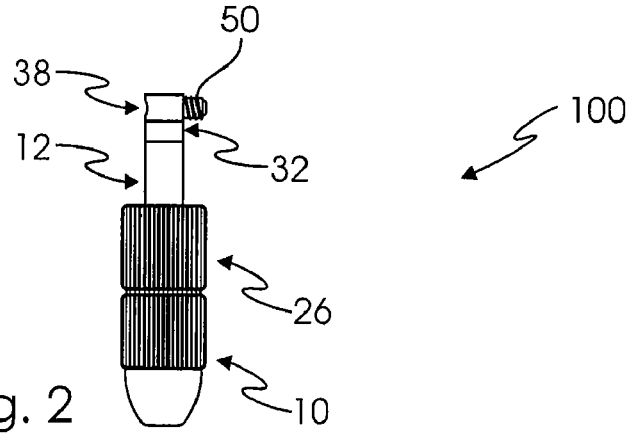
FIG. 2 is a side view of the coaxial connector of FIG. 1.

Referring to FIGS. 1 and 2, a coaxial connector 100 is shown. The coaxial connector 100 is a male or jack connector for mating with a female connector which is intended to be mounted on a ceiling mounted fixture, other supportive structure or the like (shown in FIG. 8). The connector 100 includes a connector rear cap or bottom cover 10 having a longitudinal bottom cover passageway 11 (see FIG. 3B) extending therethrough. The bottom cover passageway 11 is adapted at least at one end to threadably receive a bottom contact element or member 12.

Figure 4A:
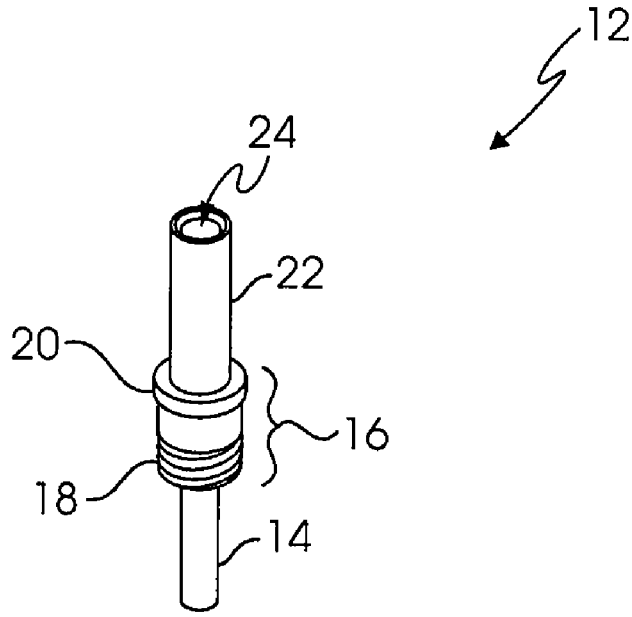
FIGS. 4*a* and 4*b* illustrate a perspective view and a cross-sectional view of a bottom contact member of the coaxial connector of FIG. 1.

As shown in FIG. 4A, the bottom contact or inner member 12 includes a tubular or cylindrical rear extension or portion 14 extending on one side thereof and rearward of a middle section 16. The middle section 16 includes toward the cylindrical rear portion side a threaded portion 18 adapted to screw into the passageway 11 to secure the bottom cover 10 to the bottom contact member 12. Toward the opposite side, the middle section 16 includes a ridge 20. The contact member 12 further includes a tubular or cylindrical front portion 22 extending from the middle portion 16 forward of the ridge 20. As shown best in FIG. 4B, the bottom contact member 12 has a central passageway 24 extending therethrough, which is adapted to be substantially aligned with the bottom cover passageway 11 when the bottom contact member 12 is threaded into the bottom cover 10.

A locking outer member or collar 26 is adapted to be positioned around the bottom contact member 12 so as to partially surround both the middle portion 16 and the front portion 22. The locking outer member 26 includes a passageway 28 having an inner diameter that is larger than an outer diameter of the middle portion 16 and at least at one portion thereof narrower than an outer diameter of the ridge 20. When the cylindrical rear portion 14 is introduced through the collar passageway 28, the locking outer member 26 slides forward over the middle portion 16 and the ridge 20 until the narrowest portion of the passageway 28 of locking outer member 26 abuts against the ridge 20. When this abutment occurs and the bottom contact member 12 is fully threaded into the bottom cover 10, the locking outer member 26 is adapted, while captured therebetween, to spin free relative to the bottom contact member 12 and the bottom cover 10. The purpose in allowing locking member 26 to spin free is to facilitate physical connection of connector 100 to a supportive structure (see FIG. 8)

The coaxial connector 100 may further include a retaining ring 30 having a "C" shape to substantially retain or lock the free-spinning locking outer member 26 in the abutting position even when the bottom cover 10 is not threaded onto the bottom contact member 12. This retaining ring 30 is adapted to be fixedly positioned onto the threaded portion 18 of the middle portion 16, behind the locking outer member 26 if present, by exercising a force or pressure on the retaining ring 30 while positioned transversally to the threaded portion 18.

The cylindrical front portion 22 of the bottom contact member 12 is adapted to threadably receive into the central passageway 24 a threaded insulator 32. The insulator 32 includes a ridge or head 34 which preferably abuts against the end of the cylindrical front portion 22 when fully threaded to each other. The insulator 32 is made of a non-conductive material, e.g., polymer or the like. The insulator 32 includes a central passageway 36 into which is mounted a top or upper contact member 38 so that the front cylindrical portion 22 and the top contact member 38 are electrically and physically isolated by the insulator 32.

As shown in FIG. 5A, the top contact member 38, which includes a leg portion 40 and a head portion 42, is adapted to be insertably mounted into the insulator 32 via the leg portion 40 until the head portion 42 abuts against the insulator 32. The leg portion 40, which is shorter that a length or depth of the insulator passageway 36 of the insulator 32, includes a ring 44 adapted to fittingly engage a notch or groove (not shown) provided internally to the insulator passageway 36 thereby providing an interference fit when desired abutment between the insulator 32 and the head portion 42 occurs, so as to securely retain the leg portion 40 within the insulator 32. The head portion 42 includes a head passageway 46 therethrough that is substantially aligned with the insulator passageway 36 when the insulator and the top contact member are secured to each other. The head portion 42 further includes a transverse threaded opening 48 adapted to receive a set screw 50 or the like. The transverse opening 48 is adapted to reach or extend into the head passageway 46.

Figure 3A:
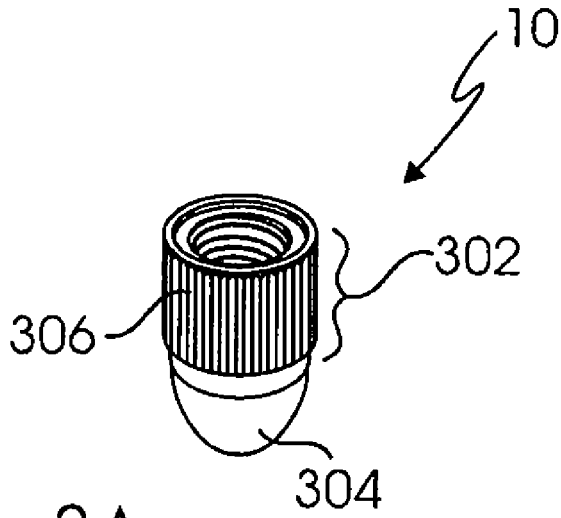
FIGS. 3*a* and 3*b* illustrate a perspective view and a cross-sectional view of a connector base cap or bottom cover of the coaxial connector of FIG. 1.
Figure 3B:
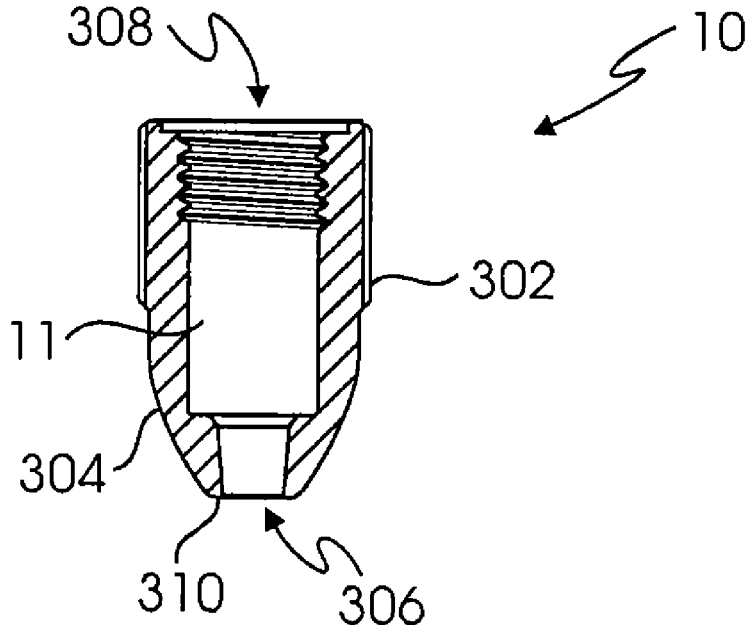

As further shown in FIGS. 3A and 3B, the bottom cover 10 preferably has a cylindrical outer shape, and includes a substantially cylindrical portion 302 that is tapered at one end 304. However, it should be understood that any other outer shape may be provided. The substantially cylindrical portion 302 of the bottom cover 10 may include longitudinal grooves 306 to enhance a user's grip during a tightening or loosening of the bottom cover 10 onto the bottom contact member 12.

The bottom cover passageway 11 is divided into an opening 306 at the tapered end 304 and a larger opening 308 at the other end. The larger opening 308 is adapted to threadably receive the bottom contact member 12 and hold internally the cylindrical rear portion 14. The narrower opening 306 has an internal diameter that is larger than the outer diameter of a coaxial cable to be received therethrough, and smaller than the outer diameter of the cylindrical rear portion 14. Alternately, the narrower opening 306 may be tapered toward the tapered end 304 of the bottom cover 10 so as to provide a narrower internal diameter that is larger than the outer diameter of the cylindrical rear portion 14 in proximity of a tip end 310 of the tapered end 304.

Figure 4B:
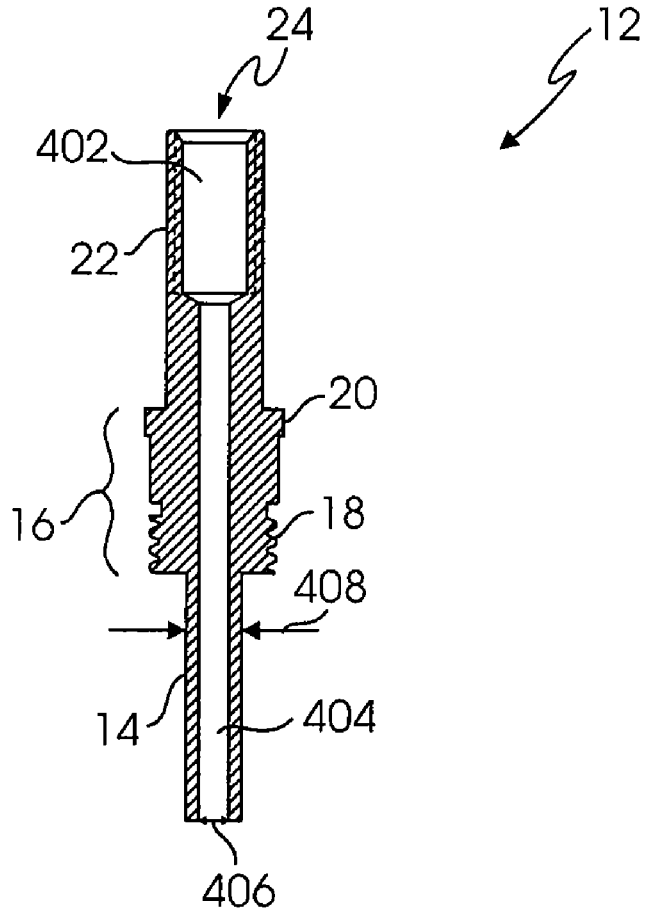

As further shown in FIGS. 4A and 4B, the bottom contact member passageway 24 is divided into an opening 402 that engages the insulator 32 and tapers into an elongated narrower opening 404 that extends through the cylindrical rear portion 14. The narrower opening 404 has an internal diameter 406 that is larger than the outer diameter of an internal insulator of the coaxial cable to be received therethrough, and smaller than the inner diameter of an external sheath or cover of the coaxial cable. Moreover, the cylindrical rear portion 14 preferably has an outer diameter 408 that is smaller than the inner diameter of the external sheath of the coaxial cable. The cylindrical rear portion 14 and the threaded portion 18 have a combined length that is shorter than a depth of the bottom cover passageway 11. In one embodiment, the combined length may be such that a tip end of the cylindrical portion 14 opposite the threaded portion 18 is flush to the tip end 310 of the tapered end 310 when the bottom contact member 12 is fully threaded into the bottom cover 10.

As further shown in FIGS. 5A and 5B, the top contact member 38 has an internal diameter 500 that is larger than the outer diameter of the internal insulator of the coaxial cable (not shown) to be received therethrough. As such, the inner insulator and wire of the coaxial cable may extend or break through a tip 502 of the head portion 42 thereby providing the user a quick determination of the presence of the insulator and inner wire of the coaxial cable.

Now referring to FIG. 6, a side view of an embodiment of a coaxial cable 600 which may be used with the coaxial connector 100 is illustrated. The coaxial cable 600 includes a conductive inner wire or cable 602 surrounded or enveloped by an insulating strip or insulator 604, which in turn is surrounded by a conductive outer braided sheath or cable or wire 606. As an example, the inner wire 602 may be a UL recognized 18 AWG stranded tinned Copper wire surrounded with a clear PerFluoroAlkoxy (PFA) insulator 604 rated at 250° C., 600 Volts, and UL flame rated VW-1. The outer sheath 606 may be made of 6-wire groups of 42 AWG (0.004 inches thick) tinned Copper braided together with a braiding density of 9-10 picks per inch, with an approximate diameter of 0.094 inches.

In accordance with the invention, the bottom contact member 12, the locking outer member 26, and the top contact member 38 are all electrically conductive and made of a metallic material, while as stated above the insulator 32 is made of a non-conductive material. The set screw 50 may be made of metal or of hardened plastic. The bottom contact member 12, the locking outer member 26, the insulator 32, and the top contact member 38 may be permanently assembled together by the manufacturer. The bottom cover 10 and the set screw 50 are threaded onto or into their mating members or components, and are intended to be removable for installation of the coaxial cable 600 into the coaxial connector 100 by the manufacturer or the user. If the set screw 50 has a sharp tip or sharp edges at the tip (not shown) and is electrically conductive, a screw tightening into the threaded opening 48 enables the set screw 50 to penetrate the insulator 604 to provide electrical contact between the inner wire 602 and the top contact member 38.

The exact designs of the connector components are illustrative and should not be limited to the sizes, dimensions and shapes shown in the figures. These connector components may be modified or changed in accordance with the same invention intent to mechanically and electrically connect other sized braided coaxial cable as needed.

Figure 7A:
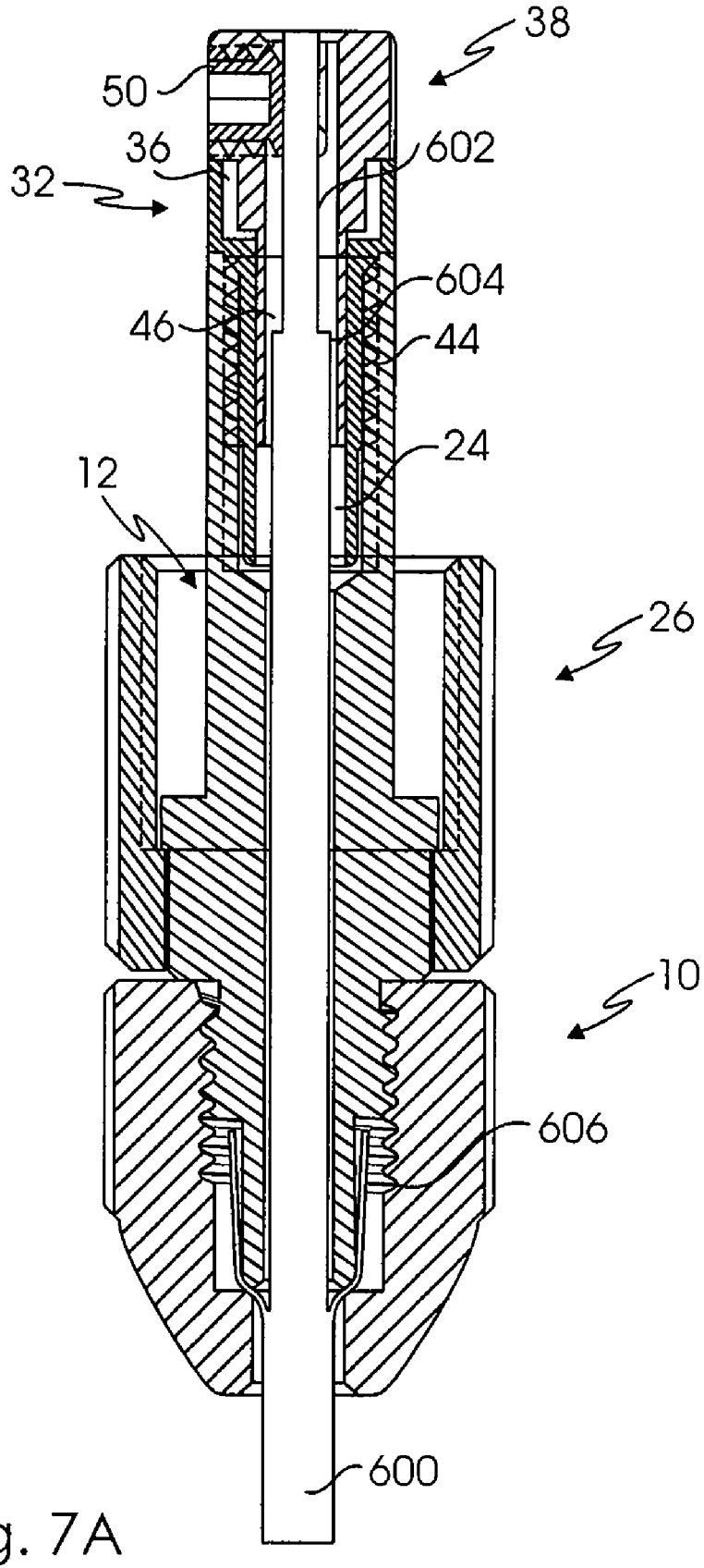
FIGS. 7A-7B illustrate cross-sectional views of two embodiments of the coaxial connector of FIG. 1, each having a coaxial cable operably disposed therein in accordance with the invention.
Figure 7B:
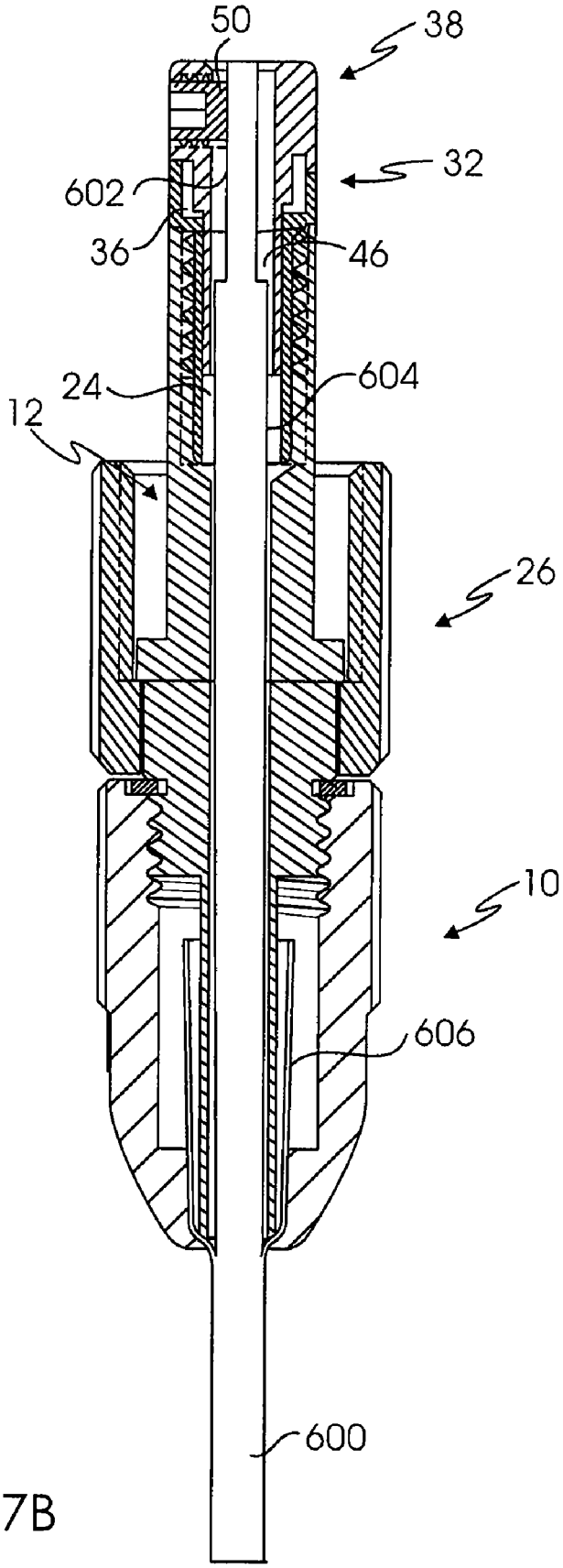

Now referring to FIGS. 7A-7B, cross-sectional views of two embodiments of the coaxial connector 100 of FIG. 1, each having a coaxial cable 600 of FIG. 6 disposed therein are illustrated. As shown in FIG. 7A, the inner wire or cable 602 has been trimmed or stripped by about ¼ of an inch prior to insertion into the coaxial connector 100. However, the insulator 604 and the braided sheath 606 need not be trimmed or shortened to expose the inner wire 602 if as discussed above the set screw 50 has a sharp tip or sharp edges at the tip (not shown) and is electrically conductive. Thus, prior to connecting the coaxial cable 600 to the connector 100, the installer or user needs only to determine a length of the coaxial cable 600 and cut all three components of the coaxial cable 600 to the determined length via sharp wire cutters or the like.

As stated above, the bottom contact member 12, the locking outer member 26, the insulator 32, and the top contact member 38 may be permanently assembled together by the manufacturer prior to connecting the coaxial cable 600 to the coaxial connector 100. As such, the bottom cover 10 is slid onto the coaxial cable 600. Then, the outer braided sheath 606 is peeled off the rest of the coaxial cable 600 by the lead end of narrow opening 404 of the cylindrical rear portion 14 exposing the insulator 604 and inner wire 602 of the coaxial cable 600. The inner wire 602 and insulator 604 can be pushed through the cylindrical rear portion 14, through the contact member passageway 24, through the insulator passageway 36, and through the top contact member passageway 46 until the inner wire 602 passes beneath the receiving opening 48 of the set screw 50 and flush to the tip 502 of the top contact member 38. At this point, the set screw 50 is tightened with a wrench or screwdriver to fixedly secure the inner wire 602 to the top contact member 38 and thus to the coaxial connector 100.

Moreover, as the insulator 604 and the inner wire 602 of the coaxial cable 600 may pass through the head passageway 46, the insulator 604 may be stripped off the wire 602 after inserting the insulator 604 and the wire 602 through and past the bottom contact member 12 and the top contact member 38. The ability to strip off the insulator 604 at this stage of assembly of the coaxial connector 100 and the coaxial cable 600 provides the installer or user with a flexible assembly as well as a flexible adjustment of a length of the coaxial cable 600 for a suitable hanging height of a pendant style electrical fixture from a supportive structure.

At this stage, the outer sheath 606 can slide over the rear portion 14 of the bottom contact member 12 until flush with the threaded portion 18 of the contact member 12, since the inner diameter of the rear portion 14 blocks the outer sheath 606 from entering the contact member passageway 24. The bottom cover 10 is slid over the bunched outer sheath 606 and threadably secured on the threaded portion 18 of the contact member 12.

Alternately, in the connector embodiment of FIG. 7B, the tapered narrower opening 306 may provide for an adjustable grip of the coaxial cable. As the bottom cover 10 is threaded onto the bottom contact member 12, a gripping or pinching force is increased on the outer sheath of the coaxial cable positioned therebetween, thereby providing simultaneously a strain relief and electrical contact between the coaxial connector 100 and the outer sheath of the coaxial cable. Moreover, the tapered configuration of the narrower opening 306 serves to minimize unwanted excessive damages to the outer sheath of the coaxial cable regardless of potential variances in the outer sheath thickness.

Figure 8:
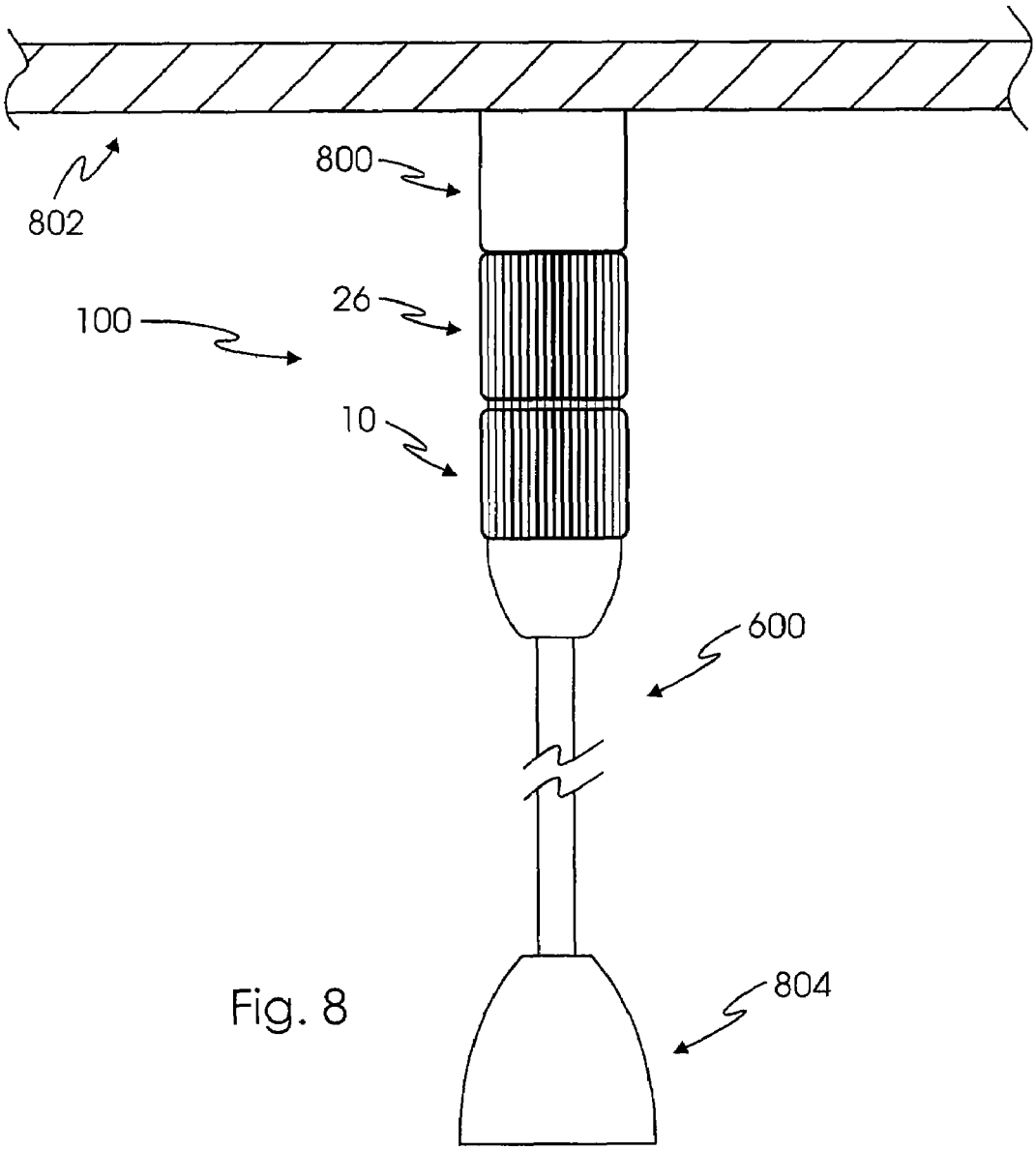
FIG. 8 illustrates schematically an electrical fixture connected to a ceiling fixture via a coaxial cable and the connector of FIG. 1 in accordance with the invention.

As illustrated schematically in FIG. 8, a mating connector 800 which is connected to a power circuit (not shown) is affixed to a ceiling fixture or supportive fixture 802 and threadably secured to the coaxial connector 100 via the locking outer member 26. The mating connector is electrically connected to the coaxial connector 100 via the top contact member 38 (not shown) and the locking outer member 26. A pendant-style electrical fixture 804 is physically connected to a bottom end of the coaxial cable 600 and electrically coupled to the power circuit via the coaxial cable 600, the coaxial connector 100, and the mating connector 800.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

The invention claimed is:

1. A connector for electrically connecting a coaxial cable having a conductive inner wire surrounded by a conductive outer jacket and an insulator therebetween to a two-wire circuit, the connector comprising:

a conductive bottom contact member having a first passageway dimensioned to fit only said inner wire and said insulator therethrough to block said conductive outer jacket;

a conductive top contact member having a second passageway, located downstream of said first passageway in a feeding direction of said coaxial cable into said connector, for said inner wire and said insulator and a clamping member for electrically contacting and securing said inner wire to said top contact member; and an insulating member for electrically separating said bottom contact member from said top contact member.

2. The connector of claim 1, wherein said bottom contact member has a tubular extension having an outer diameter narrower than an inner diameter of said jacket so that said jacket slides over said extension.

3. The connector of claim 1, wherein said top contact member has a transversal opening, said clamping member comprises a set screw threadably engaging the transversal opening.

4. The connector of claim 1, wherein said insulating member has a third passageway capable of accepting said wire and said insulator.

5. The connector of claim 1, wherein the connector physically connects an electrical fixture via the coaxial cable to a mating connector affixed to a supportive structure.

6. The connector of claim 1, further comprising a bottom cover member threadably engaging said bottom contact member for securing said outer jacket therebetween.

7. The connector of claim 6, wherein said bottom cover member is made of conductive material.

8. The connector of claim 6, wherein said bottom cover member has a fourth passageway capable of accepting said coaxial cable.

9. The connector of claim 8, wherein said fourth passageway is tapered so as to provide a gripping force on said jacket that increases as said bottom cover member is secured to the bottom contact member.

10. The connector of claim 1, further comprising a conductive outer contact member rotatably surrounding said bottom contact member and removably secured to said bottom contact member for securing said connector to a mating connector.

11. The connector of claim 10, further comprising a retaining ring for rotatably retaining said outer contact member around said bottom contact member.

12. The connector of claim 11, wherein said retaining ring is a "C" type retaining ring.

13. A connector for electrically connecting a coaxial cable having a conductive inner wire surrounded by a conductive outer jacket with an insulator therebetween to a two-wire circuit, the connector comprising:

a conductive bottom contact member having a tubular extension disposed toward said bottom member, said tubular extension having a first passageway for accepting said wire and said insulator and blocking said jacket from entry into said first passageway, a conductive outer member surrounding and removably and rotationally secured to said bottom contact member;

a conductive top contact member having a second passageway capable of accepting said inner wire and said insulator, said second passageway located downstream of said first passageway in a feeding direction of said coaxial cable into said connector;

an insulating member affixed to said conductive top contact member and secured to said bottom contact member, electrically separating said bottom contact member from said top contact member and having a third passageway capable of accepting said wire and said insulator;

a clamping member for electrically contacting and securing said inner wire to said conductive top member; and a bottom cover member adapted to be removably secured to said conductive bottom contact member, and having a fourth passageway for said coaxial cable, wherein said bottom contact member, said outer member electrically connect the conductive jacket to one wire of the circuit, and said top contact member electrically connect the inner wire to another wire of the circuit.

14. The connector of claim 13, wherein said bottom cover member is made of a conductive material.

15. The connector of claim 13, wherein said tubular extension has an outer diameter narrower than an inner diameter of said jacket so that said jacket slides over said extension.

16. The connector of claim 13, wherein said bottom contact member is removably threaded to said bottom cover member.

17. The connector of claim 13, wherein said top contact member has a transversal opening, said clamping member comprises a set screw threadably engaging the transversal opening.

18. The connector of claim 13, wherein said second passageway providing a visual opening at a top end of said top contact member.

19. The connector of claim 13, wherein said jacket is secured between said bottom contact member and said bottom cover member when said bottom contact member is secured to said bottom cover member.

20. The connector of claim 19, wherein said fourth passageway is tapered so as to provide a gripping force on said jacket that increases as said bottom cover member is secured to the bottom contact member.

21. The connector of claim 13, further comprising a retaining ring for retaining said outer member around said bottom contact member.

22. The connector of claim 21, wherein the retaining ring is a "C" type retaining ring.

* * * * *